US010350935B1

(12) United States Patent
Peters

(10) Patent No.: US 10,350,935 B1
(45) Date of Patent: Jul. 16, 2019

(54) SECURE DOCUMENT HAVING IMAGE ESTABLISHED WITH METAL COMPLEX INK

(71) Applicant: ASSA ABLOY AB, Stockholm (SE)

(72) Inventor: Eric MacKenzie Peters, Fremont, CA (US)

(73) Assignee: ASSA ABLOY AB, Stockholm (SE)

( * ) Notice: Subject to any disclaimer, the term of this patent is extended or adjusted under 35 U.S.C. 154(b) by 0 days.

(21) Appl. No.: 15/867,567

(22) Filed: Jan. 10, 2018

(51) Int. Cl.

| | |
|---|---|
| ***B42D 25/373*** | (2014.01) |
| ***B42D 25/455*** | (2014.01) |
| ***B41M 5/24*** | (2006.01) |
| ***B41M 3/14*** | (2006.01) |
| ***B42D 25/378*** | (2014.01) |
| ***B42D 25/425*** | (2014.01) |
| ***B42D 25/435*** | (2014.01) |
| ***B42D 25/328*** | (2014.01) |
| *B42D 25/351* | (2014.01) |

(52) U.S. Cl.
CPC ..... *B42D 25/373* (2014.10); *B41M 3/148* (2013.01); *B41M 5/24* (2013.01); *B42D 25/328* (2014.10); *B42D 25/378* (2014.10); *B42D 25/425* (2014.10); *B42D 25/435* (2014.10); *B42D 25/455* (2014.10); *B42D 25/351* (2014.10)

(58) Field of Classification Search
CPC .. B42D 25/373; B42D 25/455; B42D 25/378; B42D 25/328; B42D 25/435; B42D 25/425; B42D 25/351; B41M 5/24; B41M 3/148
USPC ..... 283/67, 70, 72, 74, 82, 83, 94, 98, 100
See application file for complete search history.

(56) References Cited

U.S. PATENT DOCUMENTS

| | | | |
|---|---|---|---|
| 5,786,910 | A | 7/1998 | Walters et al. |
| 7,758,078 | B2 | 7/2010 | Keller |
| 7,955,528 | B2 | 6/2011 | Chung et al. |
| 8,314,828 | B2 | 11/2012 | Bombay et al. |
| 9,266,350 | B2 | 2/2016 | Lazzari et al. |
| 2004/0166336 | A1 | 8/2004 | Lindvold et al. |
| 2006/0119912 | A1 | 6/2006 | Kutsch et al. |
| 2007/0070503 | A1 | 3/2007 | Boswell et al. |

(Continued)

FOREIGN PATENT DOCUMENTS

| | | | |
|---|---|---|---|
| DE | 102008008685 | A1 | 8/2009 |
| DE | 102010017429 | | 12/2011 |

(Continued)

OTHER PUBLICATIONS

International Search Report and Written Opinion for International (PCT) Patent Application No. PCT/EP2017/062724, dated Aug. 18, 2017, 15 pages.

(Continued)

*Primary Examiner* — Justin V Lewis
(74) *Attorney, Agent, or Firm* — Schwegman Lundberg & Woessner, P.A.

(57) ABSTRACT

A security feature, a document including a security feature, and a method of producing a document are provided. In one example a security document is disclosed to include a substrate having an embossed lacquer applied to a first side of the substrate and a metal complex ink applied to the first side of the substrate thereby covering the embossed lacquer applied to the first side of the substrate. The security document further includes a laser feature created in the metal complex ink.

20 Claims, 10 Drawing Sheets

(56) References Cited

U.S. PATENT DOCUMENTS

| | | | | |
|---|---|---|---|---|
| 2007/0183045 | A1 | 8/2007 | Schilling et al. | |
| 2009/0284813 | A1 | 11/2009 | Saito | |
| 2010/0320742 | A1 | 12/2010 | Hoffmuller et al. | |
| 2014/0319819 | A1 | 10/2014 | Power et al. | |
| 2015/0069748 | A1 | 3/2015 | Batistatos et al. | |
| 2017/0197452 | A1 | 7/2017 | Philippe et al. | |
| 2017/0326900 | A1* | 11/2017 | Fuhse | B42D 25/324 |

FOREIGN PATENT DOCUMENTS

| | | | |
|---|---|---|---|
| EP | 1110660 | | 6/2001 |
| EP | 1150843 | | 7/2004 |
| EP | 1728770 | | 12/2006 |
| EP | 2441593 | | 4/2012 |
| JP | 2009251357 | A | 10/2009 |
| JP | 2015147373 | A | 8/2015 |
| JP | 2016065180 | A | 4/2016 |
| WO | WO 2005/049745 | | 6/2005 |
| WO | WO-2006076616 | A2 | 7/2006 |
| WO | WO-2012176126 | A1 | 12/2012 |
| WO | WO-2013186167 | A2 | 12/2013 |
| WO | WO 2015/189393 | | 12/2015 |
| WO | WO 2016/096681 | | 6/2016 |
| WO | WO-2016092044 | A1 | 6/2016 |
| WO | WO-2016147481 | A1 | 9/2016 |
| WO | WO 2017/207420 | | 12/2017 |

OTHER PUBLICATIONS

"International Application Serial No. PCT/IB2018/001457, International Search Report dated Mar. 29, 2019", 6 pgs.
"International Application Serial No. PCT/IB2018/001457, Written Opinion dated Mar. 29, 2019", 6 pgs.
"International Application Serial No. PCT/IB2018/001458, International Search Report dated Mar. 19, 2019", 6 pgs.
"International Application Serial No. PCT/IB2018/001458, Written Opinion dated Mar. 19, 2019", 6 pgs.
"U.S. Appl. No. 15/867,554, Non Final Office Action dated Jan. 29, 2019", 9 pgs.

* cited by examiner

SECURE DOCUMENT HAVING IMAGE ESTABLISHED WITH METAL COMPLEX INK

FIELD

The present disclosure is generally directed to security features, security documents incorporating security features, and methods of manufacturing the same.

BACKGROUND

The use of identification documents and other credentials is pervasive. Credentials are used on a daily basis for a number of different purposes. Credentials, which may also be referred to as secure documents, are most commonly used to prove identity, to verify age, to access an asset (e.g., secure area, financial account, computing resource, etc.), to evidence driving privileges, to cash a check, and so on. Airplane passengers are required to show a credential during check in, and sometimes at security screening and prior to boarding their flight. We also live in an ever-evolving cashless society where credentials are used to make payments, access an automated teller machine (ATM), debit an account, or make a payment, etc. Many industries require that their employees carry photo identification credentials on the job and to access various locations on a job site.

While many different types of security features have been developed to enhance the security associated with credentials, optical or holographic security features have been among the most popular features developed in the last decade thanks to their difficulty to copy and the ease with which they can be verified. The diffractive effects of surface relief structures is known. However, traditional methods of producing diffractive effects are inefficient in most cases.

SUMMARY

Embodiments of the present disclosure aim to overcome the shortcomings described above. In some embodiments, a credential manufacturing process can begin when a roll of material (e.g., a Polycarbonate (PC)) substrate is received having an embossed lacquer applied thereto. The embossed lacquer may be cured using any type of known curing techniques (e.g., Ultraviolet (UV) light, Infrared (IR) light, heat, chemical, etc.). Thereafter, a metal complex ink is applied to the PC substrate having the embossed lacquer applied thereto. The metal complex ink can be applied with any type of known or yet to be developed inkjet print head, including standard commercial inkjet print heads. The metal complex is then quickly cured (e.g., within 1-10 seconds of application of the ink) such that the dried metal complex has a mirror-like finish. Curing can be achieved by application of hot air and/or UV radiation with little solvent emission. The cured metal complex will have a thickness between 1 and 5 microns. At this point the PC substrate, which may be between 50-75 microns thick, has a thin metal complex structure cured on top of it.

The substrate having its thin metal complex structure can then be laminated with other PC structures into a card format. These additional layers may be printed or not, with or without chips, etc. Some of these layers may be laseable or otherwise be configured for personalization. In some embodiments, the metal complex is laseable (e.g., capable of being treated with laser energy). Treatment of the metal complex with laser energy may involve ablating (e.g., removing) at least some of the metal complex material from the rest of the material remaining in the thin metal complex structure. In other embodiments, treatment of the metal complex with laser energy may involve simply exposing the metal complex ink to laser energy such that a visible property of the metal complex ink changes. For instance, the metal complex ink may turn a different color, have a different diffraction effect, or otherwise appear differently from other portions of the metal complex ink that have not been treated or had laser energy applied thereto.

The metal complex may be a metal complex ink having any type of metal particulates therein (e.g., silver, copper, gold, etc.) that is applied through inkjet printing heads in bands up to 65 mm wide. The inkjet printing heads may have a resolution of 200 dbi, 400 dbi, 800 dbi or any other suitable resolution that enables a smooth application of the chosen metal complex ink. As an alternative to metal complex ink, a nanoparticle silver may be used. Ideally, a metal complex ink should be chosen that works well with the selected substrate material. For example, it may be desirable to use a metal complex ink having a lower curing temperature than the PC substrate so that the ink can cure without disrupting the substrate. Selections of different substrate materials may also be useful. For instance, a PC copolymer may be ideal, but other types of PC substrates may be used as well.

In some embodiments, a plasmonic effect is created in the holographic feature and/or the metal complex ink. In particular, selective laser ablation techniques may be used to remove portions of a holographic feature and/or portions of metal complex ink. The selective laser ablation of these portions may result in the creation of an image with the remaining materials. Thus, a plasmonic effect or plasmonic structure is created within the holography. If the metal complex ink and/or holographic features are created in an appropriate way, the security features achieved with the selective laser ablation can be both easy to identify and difficult to counterfeit.

After the metal complex structure is cured on top of the PC substrate, additional types of PC layers may be applied to the substrate. These layers may have windows or other known types of features. The metal complex surface finish can vary (gloss to matte) and can be different when viewed on opposite sides. The additional PC layers may be laminated to the PC substrate to form the desired layers of a secure document. At this point, the layers are still in a roll format.

One or more high-quality images may be laser-engraved into the outermost PC layer(s). This may correspond to a card personalization step. Engraving may occur before or after lamination. The rolls material may then be cut/singulated to create multiple documents (e.g., cards, passports, printed IDs, RFIDs, etc.).

For the purposes of this disclosure, credentials are broadly defined and may include, for example, credit cards, bank cards, phone cards, passports, driver's licenses, network access cards, employee badges, debit cards, security cards, visas, immigration documentation, national ID cards, citizenship cards, social security cards, security badges, certificates, identification cards or documents, voter registration cards, police ID cards, border crossing cards, legal instruments or documentation, security clearance badges and cards, gun permits, gift certificates or cards, labels or product packaging, membership cards or badges, etc. Also, the terms "document," "credential," "card," and "documentation" are used interchangeably throughout this document. Credentials are also sometimes interchangeably referred to as "security documents," "ID documents," "identification documents," "security credentials," "photo-IDs," and "photo ID documents".

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. When each one of A, B, and C in the above expressions refers to an element, such as X, Y, and Z, or class of elements, such as $X_1$-$X_n$, $Y_1$-$Y_m$, and $Z_1$-$Z_o$, the phrase is intended to refer to a single element selected from X, Y, and Z, a combination of elements selected from the same class (e.g., $X_1$ and $X_2$) as well as a combination of elements selected from two or more classes (e.g., $Y_1$ and $Z_o$).

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The terms "determine," "calculate," and "compute," and variations thereof, as used herein, are used interchangeably and include any type of methodology, process, mathematical operation, or technique.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

BRIEF DESCRIPTION OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Copyright and Legal Notices

A portion of the disclosure of this patent document contains material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

According to one embodiment of the present disclosure, a method of manufacturing a secure document is provided, comprising:

receiving a substrate having an embossed lacquer applied to a first side of the substrate;

applying a metal complex ink in an array format to the first side of the substrate;

curing the metal complex ink within a predetermined amount of time of applying the metal complex ink to the first side of the substrate; and applying laser energy to predetermine portions of the metal complex ink to produce an image within the array of the metal complex ink.

Figure 1:
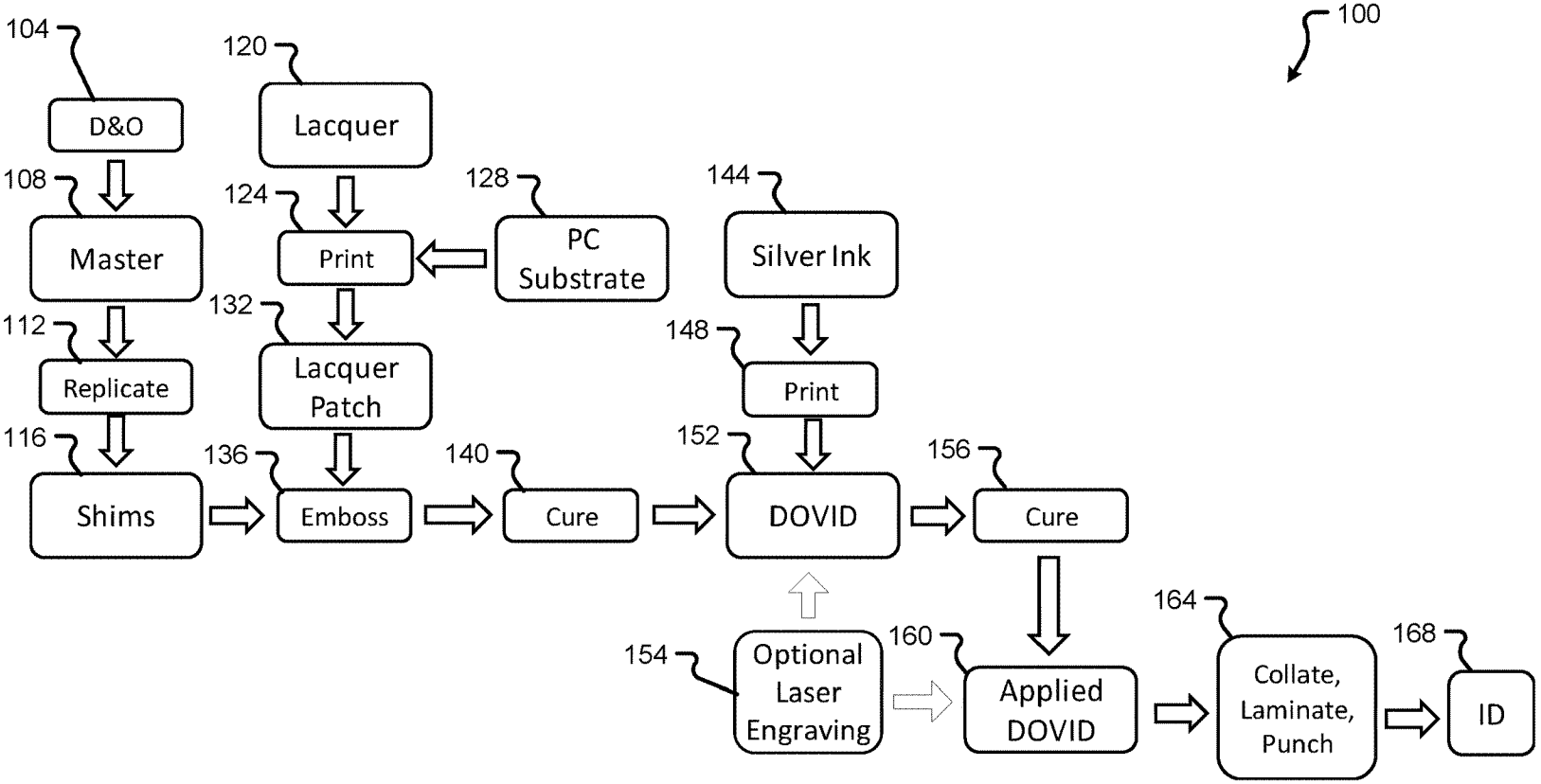
FIG. 1 is a flow diagram depicting a method of manufacturing a secure document in accordance with at least some embodiments of the present disclosure.

With reference now to FIG. 1, additional details of a method 100 for manufacturing a secure document will be described in accordance with at least some embodiments of the present disclosure. The method 100 begins with a design and origination process (step 104). In this process, various design details for a security feature and/or security document having a security feature are contemplated. The design of the security feature and/or document is then incorporated into a master mold or die (step 108). This master mold or die is used to produce one or more replicas (step 112) in the form of shims (step 116). In some embodiments, where the security feature corresponds to a holographic feature, the shims may correspond to holographic shims that can be used to emboss a substrate during an embossing process.

The method 100 continues when a substrate, such as a polycarbonate (PC) substrate, is received (step 128) and has one or more layers of lacquer applied thereto (step 120) in a printing process (step 124). In some embodiments, the lacquer is applied to the PC substrate using a lacquer patch (step 132) and embossing process (step 136). A non-limiting example of such a process corresponds to a Holoprint® process, details of which are provided in EP 1150843 B1 and/or U.S. Patent Publication No. 2004/0166336 to Lindvold et al., the entire contents of which are hereby incorporated herein by reference. The resulting product is a PC substrate having an embossed lacquer on at least one side thereof.

The lacquer may then be cured in a first curing process (step 140). The lacquer may be cured using heat, light, or a combination thereof. This product may then have a metal complex ink (e.g., a silver complex ink) applied thereto (step 144). In some embodiments, the metal complex ink is applied to the product using an inkjet print head (step 148). At this point, the metal complex ink overlies the embossed lacquer, thereby creating one or more holographic features on the substrate (step 152). In some embodiments, the resulting product can be referred to as a Diffractive Optically Variable Image Device (DOVID) or an intermediary product of a security document. The metal complex may be cured (step 156) using heat, light, or a combination thereof. In some embodiments, the metal complex applied to the substrate is cured within a predetermined amount of time of the metal complex ink being applied to the substrate. As a non-limiting example, the substrate may have the metal complex ink printed thereon and the metal complex ink may be cured within no more than ten seconds of application. This relatively short amount of time between metal complex ink application and curing helps to create an optically-appealing holographic feature. Even more specifically, the holographic feature may include a mirror-like finish that is interrupted only by the embossed lacquer. The combination of the embossed lacquer and metal complex ink applied thereto creates a holographic feature on the substrate.

In at least some embodiments, prior to having the metal complex ink applied thereto, the substrate and the embossed lacquer may have laser energy applied thereto (step 154). In some embodiments, the laser may alter an appearance of the lacquer and/or remove at least some material of the hologram created with the lacquer, thereby resulting in a laser-treated holographic feature on the substrate.

After the metal complex ink has been applied and cured, the resulting product may be referred to as an applied DOVID (step 160). As mentioned above, this applied DOVID may have a laser-treated holographic feature present underneath the metal complex ink. In some embodiments, the holographic feature may only be provided on a portion of the substrate whereas other portions of the substrate do not have the holographic feature applied thereto. An additional or optional laser engraving process may be performed on the applied DOVID (step 154). In this step, the metal complex ink may have laser energy applied thereto. This application of laser energy may result in a removal of at least some of the metal complex ink. In other embodiments, the laser energy may not be sufficient to remove the material of the metal complex ink, but the laser energy may be sufficient enough to change an appearance of the metal complex ink (e.g., by sintering or otherwise heating the metal complex ink). In some embodiments, the application of the laser energy may change the metal complex ink into a metal oxide, which means that the metal complex ink may be transformed rather than removed via ablation. The application of additional laser energy may help to further enhance the security feature created by the holographic feature and the metal complex ink.

One or more additional layers may then be provided on the applied DOVID (step 164). Alternatively or additionally, electronic components (e.g., an Integrated Circuit (IC) chip, an antenna, electronic traces, etc.) may be provided on the applied DOVID. These additional layers and/or electronic components may be laminated via application of heat and/or pressure. In some embodiments, the metal complex ink comprises a higher melting temperature and/or lower curing temperature than the other layers (e.g., the substrate and additional layers) so that the lamination step does not melt, reflow, or otherwise cause the metal complex ink to undesirably alter in any way. If the substrate was provided in a sheet or web-based format such that a plurality of cards are manufactured on a single sheet, the method 100 may further include punching or singulating individual documents from the sheet or web. This results in the production of one or many secure documents, which may also be referred to as secure IDs (step 168).

Figure 2:
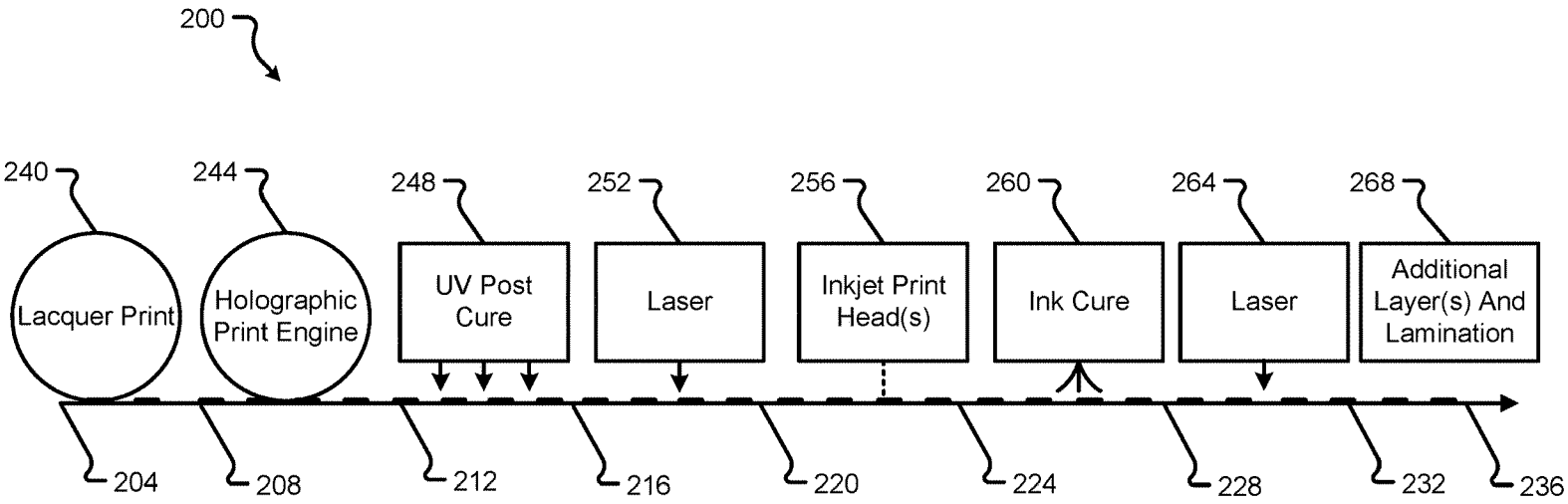
FIG. 2 is a diagram depicting components used to manufacture a secure document in accordance with at least some embodiments of the present disclosure.

With reference now to FIG. 2, additional details of the components 200 used to manufacture a secure document or a plurality of secure documents will be described in accordance with at least some embodiments of the present disclosure. In the depicted embodiment, a plurality of secure documents may be manufactured simultaneously from a sheet or web-based format of a substrate. In particular, embodiments of the present disclosure provide a method and system 200 for manufacturing a plurality of secure documents in-line, meaning that a single web-based substrate can be passed through a plurality of processes without the need for cutting the web-based substrate or otherwise manually moving a sheet of substrate from one machine to another.

As shown in FIG. 2, a roll of substrate 204 is fed to a lacquer printer 240. The lacquer printer 240 may apply a first layer of lacquer to the substrate 204. The lacquer applied by the lacquer printer 240 may further be embossed with an impression cylinder or the like. In some embodiments, a flexographic print roll is used to simultaneously apply a layer of lacquer to the web-based substrate (which may correspond to a polycarbonate sheet of material) and emboss that layer of lacquer. At this point the web-based substrate now has a layer of embossed lacquer 208, which can be provided to a holographic print engine 244. In some embodiments, the holographic print engine 244 is used to pattern and simultaneously cure the lacquer. The output of the holographic print engine 212 may then pass through an additional cure process 248. In some embodiments, UV light and/or heat is used to further cure the embossed lacquer and ensure that the patterns applied thereto by the holographic print engine 244 are totally cured and maintained.

The web-based substrate having the embossed and cured lacquer 216 may then be optionally treated with a laser 252. This laser 252 may remove at least some portions of the lacquer applied by the holographic print engine 244. The substrate with the laser-treated holographic feature 220 is then passed under one or more inkjet print heads 256. The inkjet print heads 256, in some embodiments, may correspond to commercial inkjet printing heads configured to deliver a metal complex ink in bands up to 65 mm wide and at a resolution of 200 dbi, 400 dbi, 800 dbi or any other suitable resolution that enables a smooth application of the chosen metal complex ink onto the web-based substrate. In some embodiments, the metal complex ink may be applied to have a thickness between 1 and 5 microns.

The selection of the type of metal complex ink applied by the inkjet print head(s) 256 can depend upon the type of substrate being used and the desired effects of a security feature that will result from the application of the metal complex ink. Non-limiting types of metal complex inks that may be used include silver complex inks, copper complex inks, gold complex inks, etc. Even more specifically, the metal complex ink may correspond to a homogenous liquid where the metal is present as a metal salt or metal complex. Alternatively or additionally, the metal complex ink may have metal particles or flakes suspended therein and the sizes of such particles may be no larger than 10 nanometers and may be distributed substantially randomly throughout a liquid of the ink. In some embodiments, a plurality of inkjet print heads 256 are used to apply a metal complex ink (or different metal complex inks) to different areas of the substrate (e.g., areas where a security feature is desired and/or an area where the embossed lacquer has already been applied).

The uncured metal complex ink(s) is applied to the substrate in a layer having a substantially uniform thickness. By applying the metal complex ink in a substantially uniform layer, the metal complex ink is allowed to conform to the embossed lacquer, thereby creating a conformal layer of metal complex ink. It should be appreciated that the layer of metal complex ink may be completely conformal to the features created by the embossed lacquer, partially conformal to the features created by the embossed lacquer, or interrupted with features created by the embossed lacquer. The application of the metal complex ink by the inkjet print heads corresponds to one of many possible application methods. Other methods which may be used to apply the metal complex ink include, without limitation, flexographic application methods, slot coating application methods, gravure application methods, etc. Indeed, any methods suitable to apply the metal complex ink to the web-based substrate can be used without departing from the scope of the present disclosure.

The substrate having the uncured metal complex ink 224 is quickly passed to an ink curing station 260. In the ink cure station 260, the metal complex ink 224 is exposed to environmental conditions that cause the metal complex ink to cure. In some embodiments, the ink cure station 260 is positioned substantially adjacent to the inkjet print head(s) 256 such that the metal complex ink is cure within a predetermined amount of time of application to the substrate. More specifically, a quick curing of the metal complex ink is desirable to help achieve a mirror-like finish with the layer of metal complex ink and to help ensure that the layer at least substantially conforms to the embossed lacquer. In some embodiments, the ink cure station 260 exposes the metal complex ink to UV light within 1-10 seconds and no more than 10 seconds of being applied to the substrate. In some embodiments, the metal complex ink may be cured using a combination of UV light and/or hot air drying heads that force hot and dry air onto the metal complex ink. This curing process substantially transforms the metal complex ink into a metal layer. For instance, a silver complex ink may be substantially transformed to a layer of silver having a substantially uniform thickness and a mirror-like finish. These features enable the cured metal layer to exhibit holographic properties and other security-related properties.

At this point the substrate having the cured metal complex ink 228 may be subjected to another laser 264. This laser 264 may be the same as or different from the laser 252. In some embodiments, this laser 264 is used to treat, alter, or ablate at least some material applied by the inkjet print head(s) 256. The substrate with the laser-treated metal complex ink 232 may then be passed to one or more additional processes 268 to ultimately result in the creation of one or many secure documents 236. In some embodiments, the substrate (in a web-based format) having the cured and laser-treated metal complex ink 232 is cut into sheets and those sheets are collated with other printed sheets, other electronic components (e.g., antennas, IC chips, etc.), protective overlay sheets, and the like. These additional sheets of material and electronic components may then be laminated together under application of heat and pressure.

The laminated sheets may then further be singulated or have individual secure documents cut therefrom. Thus, the production process can output a plurality of secure documents from a single sheet of material.

Figure 3A:
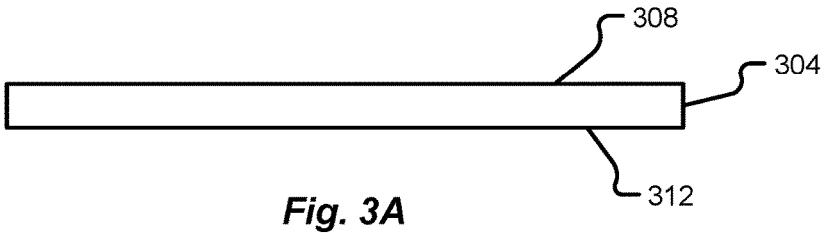
FIG. 3A is a cross-sectional view of a substrate used during production of a secure document in accordance with at least some embodiments of the present disclosure.

With reference now to FIGS. 3A-I, the construction of a secure document or components thereof will be described in accordance with at least some embodiments of the present disclosure. With reference initially to FIG. 3A, a substrate 304 is shown to include a first side 308 and an opposing second side 312. Although the substrate 304 is shown to have first and second ends connecting the first and second sides 308, 312, it should be appreciated that the substrate 304 is provided in a web-based format, a roll, a sheet, or the like such that the distance between the ends of the substrate 304 is significantly smaller than the length of the sides 308, 312. Said another way, the substrate 304 may be relatively thin even though FIG. 3A depicts the substrate 304 as having a significant thickness.

In some embodiments, the substrate 304 corresponds to a layer of polycarbonate or a PC copolymer. The substrate 304 may have a thickness between approximately 50 microns and 75 microns. The thickness of the substrate 304 may depend, at least in part, upon the desired final thickness of the security document to be made with the substrate 304.

Figure 3B:
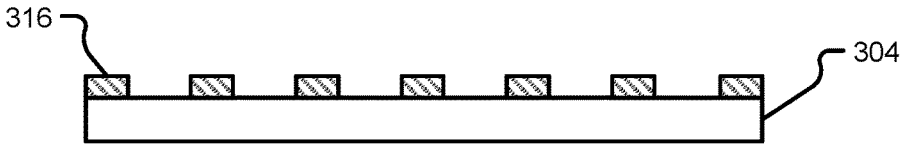
FIG. 3B is a cross-sectional view of a first layered structure used to produce a secure document in accordance with at least some embodiments of the present disclosure.

FIG. 3B depicts the substrate 304 having an embossed lacquer 316 applied thereto. More specifically, the embossed lacquer 316 may be applied to the first side 308 of the substrate 304. Although not depicted, it should be appreciated that the embossed lacquer 316 may alternatively or additionally be applied to the second side 312 of the substrate 304 without departing from the scope of the present disclosure. The embossed lacquer 316 may have any number of possible formats or designs provided thereon. The depiction of the embossed lacquer 316 as corresponding to a plurality of uniform ridges that are evenly spaced apart is for ease of discussion and clarity.

Figure 3C:
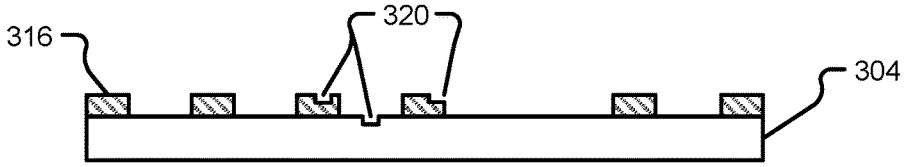
FIG. 3C is a cross-sectional view of the first layered structure of FIG. 3B after having laser energy applied thereto in accordance with at least some embodiments of the present disclosure.

FIG. 3C depicts an embodiment of the substrate 304 and embossed lacquer 316 after having been subjected to laser energy. In particular, a laser 252 may be used to incorporate one or more features into the holographic image created by the embossed lacquer 316. Even more specifically, laser energy may be used to create one or more laser features 320 in the embossed lacquer 316, in the first surface 308 of the substrate 304, or a combination thereof. As can be seen in FIG. 3C, the laser energy may remove at least some material of the embossed lacquer 316 and/or substrate 304. In some embodiments, the laser energy may actually remove an entire row or ridge of the embossed lacquer 316. This may also be referred to as a laser feature 320 even though no such feature is actually present in the form of an embossed lacquer 316 ridge. As noted above, however, this laser engraving step may correspond to an optional step in the manufacture of the security document.

Figure 3D:
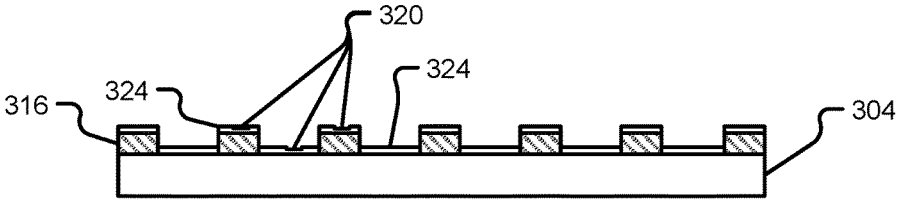
FIG. 3D is a cross-sectional view of a second layered structure used to produce a secure document in accordance with at least some embodiments of the present disclosure.
Figure 3E:
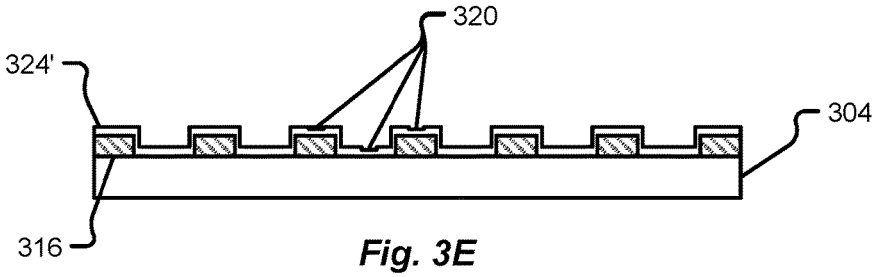
FIG. 3E is a cross-sectional view of an alternative format of the second layered structure depicted in FIG. 3D.
Figure 3F:
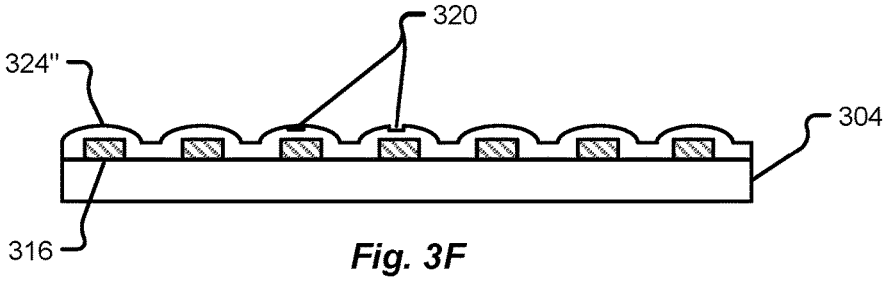
FIG. 3F is a cross-sectional view of an alternative format of the second layered structure depicted in FIG. 3D.

FIGS. 3D-F depict various possible intermediate products that can be realized by applying a metal complex layer 324, 324', 324" to the first side 308 of the substrate 304 over the raised features created by the embossed lacquer 316 and then treating the metal complex layer with laser energy, thereby creating one or more laser features 320 in the metal complex layer. In particular, FIG. 3D shows a first configuration where the metal complex ink 324 is applied in a relatively uniform thickness across the first side 308 of the substrate 304. It can be seen that the thickness of the metal complex ink 324 is less than a thickness of a feature created by the embossed lacquer 316. For instance, the metal complex ink 324 may be applied to have a thickness between 1 and 5 microns and the features created by the embossed lacquer 316 may have a thickness between 2 and 10 microns. Thus, at least some side portions of the features created by the embossed lacquer 316 may not be covered by the metal complex ink 324. Rather, the top surfaces of the features created by the embossed lacquer 316 and the exposed portions of the first side 308 of the substrate 304 may be uniformly covered with the metal complex ink 324. On the other hand, at least some portions of the features created by the embossed lacquer 316 (e.g., vertical walls, inclines, etc.) may not be covered with the metal complex ink 324.

Once the metal complex ink 324 is applied to the substrate 304 and cured, the laser 264 may be used to treat at least some portions of the cured metal complex ink 324. As shown in FIG. 3D, the laser feature(s) 320 may correspond to voids in the metal complex ink 324 where at least some material has been removed/ablated. Alternatively, or additionally, the laser feature(s) 320 may correspond to areas of the metal complex ink 324 that have been transformed and present at least one different visual characteristic than other portions of the metal complex ink 324 that have not been subjected to laser energy. As can be appreciated, these laser feature(s) 320 may be present on top of the features created by the embossed lacquer 316 or they may be present between the embossed lacquer 316.

FIG. 3E depicts an alternative configuration where the metal complex ink 324' is applied uniformly across the embossed lacquer 316 and the first side 308 of the substrate 304. In this example, the entirety of the features created by the embossed lacquer 316 is covered by the metal complex ink 324'. The thickness of the metal complex ink 324' may be similar to that depicted and described in connection with FIG. 3D; however, the metal complex ink 324' may be applied in a thick enough layer to maintain the layer thickness between the peaks and valleys of the features created by the embossed lacquer 316. When cured appropriately, this particular configuration may help to create a holographic feature with the metal complex ink substantially conforming to the features created by the embossed lacquer 316. The metal complex ink 324' may then be subjected to laser energy from the laser 264, thereby creating one or more laser features 320. Again, these laser features 320 may correspond to voids of material or areas of the metal complex ink 324' that have been transformed into a metal oxide. The laser features 320 may be visible from just the first side 308 of the substrate 304 or the laser features 320 may be visible from the second side 312 of the substrate 304 if an appropriate window is provided in the substrate 304

FIG. 3F depicts another alternative configuration where the metal complex ink 324" is conformally applied to the substrate 304 and embossed lacquer 316, but is thicker in the valleys between the features created by the embossed lacquer 316 than the peaks created by the embossed lacquer 316. This particular configuration still presents the metal complex ink 324" in substantial conformity with the embossed lacquer 316 as shown in FIG. 3E. However, the metal complex ink 324" in this configuration is not completely uniform in its thickness. The features created by the embossed lacquer 316 still create the contours in the metal complex ink 324" and will, therefore, contribute to the appearance of the security features resulting from the metal complex ink 324". An advantage to this particular configuration is that the application of additional layers to the first side 308 of the substrate may be easier to accommodate as compared to other configurations where the embossed features create a less smooth surface for lamination.

Again, one or more laser features 320 may be created in the metal complex ink 324". This particular embodiment shows the laser features 320 substantially overlapping the embossed lacquer 316 ridges/features, but it should be appreciated that one or more laser features 320 may also be provided in the troughs between the embossed lacquer 316 ridges/features.

Although FIGS. 3D-F only depict laser features 320 in metal complex layer, it should be appreciated that embodiments of the present disclosure also contemplate that laser features 320 may be provided in two or more of the substrate 304, the embossed lacquer 316, and/or the metal complex layer. These features 320 may be created using two different laser application processes (as shown in FIG. 2) or a suitably strong laser may be used to ablate through the thickness of the metal complex layer and at least some of the embossed lacquer 316. Thus, a single laser feature 320 may be present in the metal complex layer 324 as well as the embossed lacquer 316. Such a laser feature 320 may be useful to prevent counterfeiting due to the laser feature 320 being applied at a single, but specific step, thereby creating a unique-looking feature.

Figure 3G:
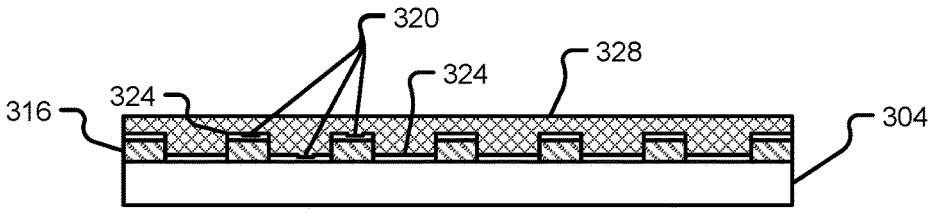
FIG. 3G is a cross-sectional view of a third layered structure used to produce a secure document in accordance with at least some embodiments of the present disclosure.
Figure 3H:
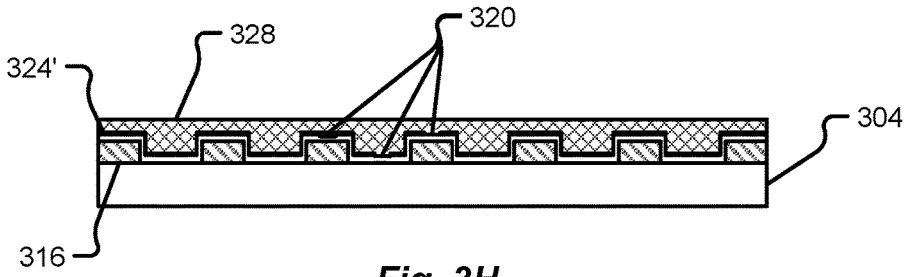
FIG. 3H is a cross-sectional view of an alternative format of the third layered structure depicted in FIG. 3G.
Figure 3I:
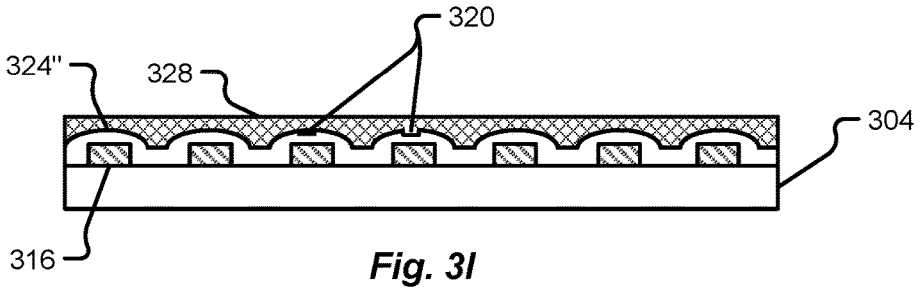
FIG. 3I is a cross-sectional view of an alternative format of the third layered structure depicted in FIG. 3G.

FIGS. 3G-I depict further possible intermediate products that can be realized with the intermediate products of Figs. D-F. In particular, FIG. 3G shows an intermediate product created by applying at least one additional layer 328 to the intermediate product of FIG. 3D. In some embodiments, the at least one additional layer 328 may correspond to an additional PC layer. Alternatively or additionally, other materials may be used for the additional layer 328. For instance, clear or semi-transparent plastics such at PET, PVC, etc. may be used for the at least one additional layer 328. FIG. 3H shows an intermediate product against created with at least one additional layer 328 applied to the intermediate product of FIG. 3E. FIG. 3I shows an intermediate product created with at least one additional layer 328 applied to the intermediate product of FIG. 3F. It should be appreciated that more than one additional layer may be applied to the substrate 304 having the metal complex ink cured thereon. Additional laser engraving steps may be performed on the at least one additional layer 328. For instance, personalization of the document may be achieved by further laser engraving the top-most layer among the additional layers 328. This may be done in addition to the other laser engraving steps discussed herein.

It should be appreciated that the substrate 304 can be sandwiched between additional layer 328 and other additional layers. More than two additional layers may further be applied to the stack of layers. For instance, a third additional layer and fourth additional layer may also be provided to the stack of layers and all of these layers of materials may be laminated together to create a cohesive security document.

Electronic components may also be incorporated into the stack of layers. The electronic component(s) may correspond to one or more of an IC chip, an antenna, an electrical trace, etc. As is known in the art, the electronic component may be incorporated into the stack of layers using lamination techniques. Alternatively or additionally, one or more recesses or reliefs may be formed in an additional layer to accommodate the electronic component and to avoid an undesirable bump around the electronic component.

Figure 4:
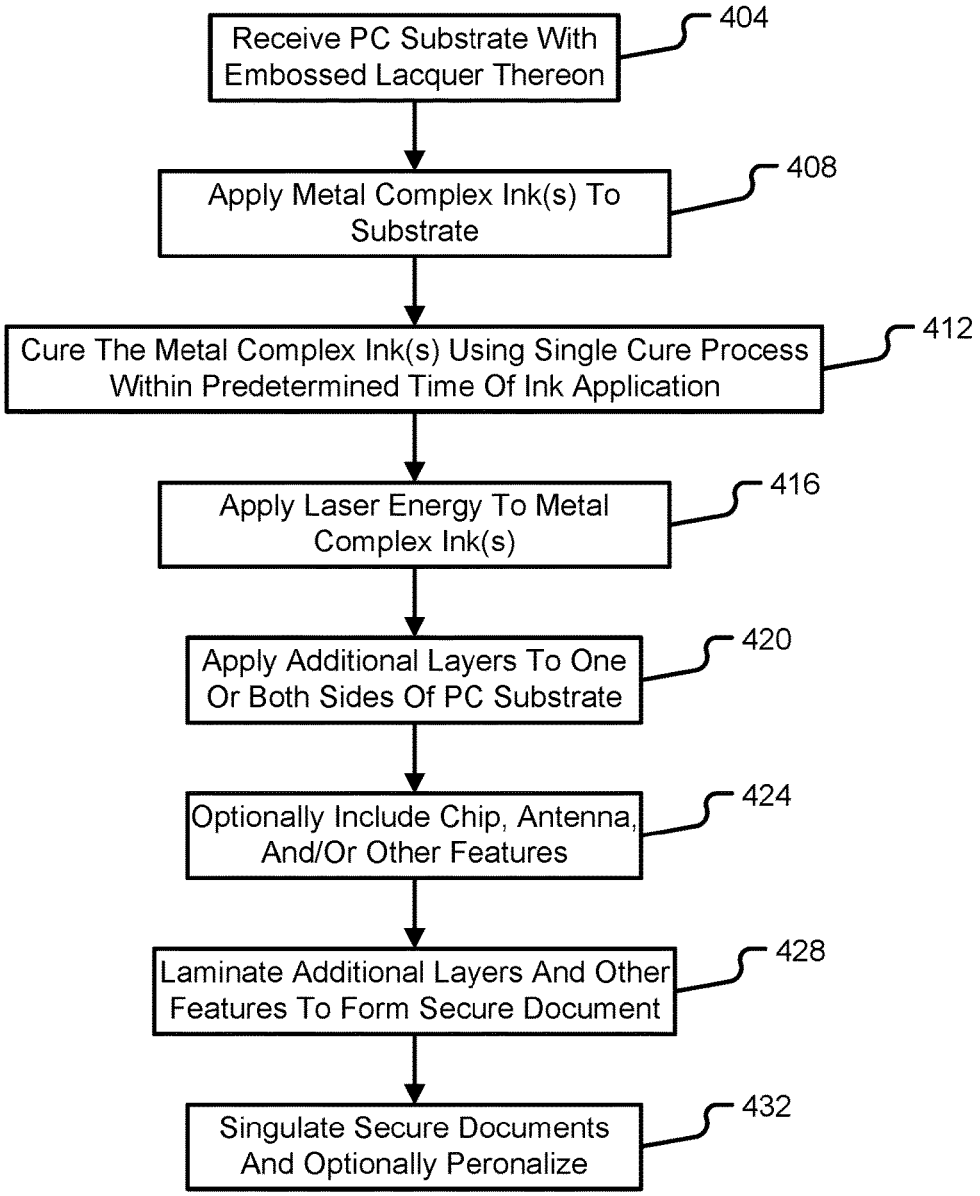
FIG. 4 is a flow chart depicting a method of producing a secure document in accordance with at least some embodiments of the present disclosure.

With reference now to FIG. 4, another method of manufacturing a secure document will be described in accordance with at least some embodiments of the present disclosure. The method begins when a PC substrate with an embossed lacquer provided thereon is received (step 404). The embossed lacquer may be cured on the substrate and may cover a portion or the entire area of the substrate.

The method continues with the application of one or many different types of metal complex inks to at least one side of the PC substrate (step 408). In some embodiments, a single metal complex ink is applied to the side of the PC substrate. In some embodiments, a plurality of different metal complex inks are applied to the side of the PC substrate. The metal complex inks are applied to the side of the substrate having the embossed lacquer formed thereon. In some embodiments, a first of the plurality of metal complex inks may correspond to a silver complex ink whereas a second of the plurality of metal complex inks may correspond to a gold or copper complex ink. Alternatively or additionally, both metal complex inks may correspond to a silver complex ink, but with different solvents or liquid formulations. For example, one of the metal complex inks may have an alcohol or ester solvent whereas another of the metal complex inks may have ketones or glycol ethers as a solvent. Furthermore, the different metal complex inks may be applied to the substrate and the embossed lacquer with different inkjet print heads. Thus, the different metal complex inks may be applied side-by-side or adjacent to one another, thereby creating a difference in optical characteristics from one metal complex ink to the next metal complex ink. The metal complex inks may be applied with a small (e.g., less than 5 micron) gap provided therebetween. Alternatively, a small amount of overlap between the metal complex inks may be tolerated. The existence of gaps or the lack thereof may depend upon the resolution of the inkjet print heads and the viscosity of the metal complex ink.

Because the metal complex inks are applied at substantially the same time, it may be possible to cure all of the different metal complex inks with a common curing process (step 412). In particular, the method continues by exposing the substrate with the different metal complex inks applied thereto to a common curing process within a predetermined amount of time of the application of such metal complex inks. As a non-limiting example, the metal complex inks may be exposed to UV light and/or heated air within 1-10 seconds of being applied to the substrate. This relatively quick application of a curing process helps to create a mirror-like finish for the metal complex ink.

Thereafter, the metal complex ink(s) may then be subjected to laser energy (step 416). In this step, a single laser, is used to create one or more laser features in each of the different metal complex materials. The laser may be used to create a single image that traverses each of the different metal complex materials. The laser may be strong enough to remove at least some material or the laser may be used to transform the metal complex layer(s) to a metal oxide or the like.

The method continues with the application of one or more additional layers to one or both sides of the substrate (step 420). The method may also include providing one or more electronic components to the tack of layers created by the PC substrate and the additional layers (step 424). The additional layers and/or electronic component(s) may then be laminated together with the application of heat and/or pressure to create a desired laminated stack for a secure document (step 428).

If the laminated stack is provided in a sheet or roll format, the method may further include singulating or cutting individual secure documents from the sheet or roll (step 432). Additional personalization steps may then be performed in which the outermost layers of the secure document are either laser engraved or printed with colored ink(s).

Figure 5A:
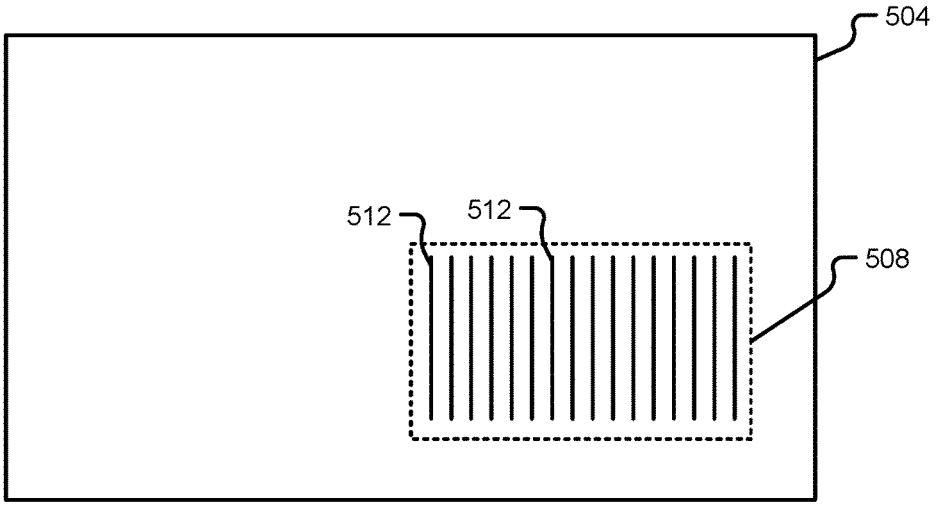
FIG. 5A is a diagram depicting a first example of a security feature prior to laser treatment in accordance with at least some embodiments of the present disclosure.
Figure 5B:
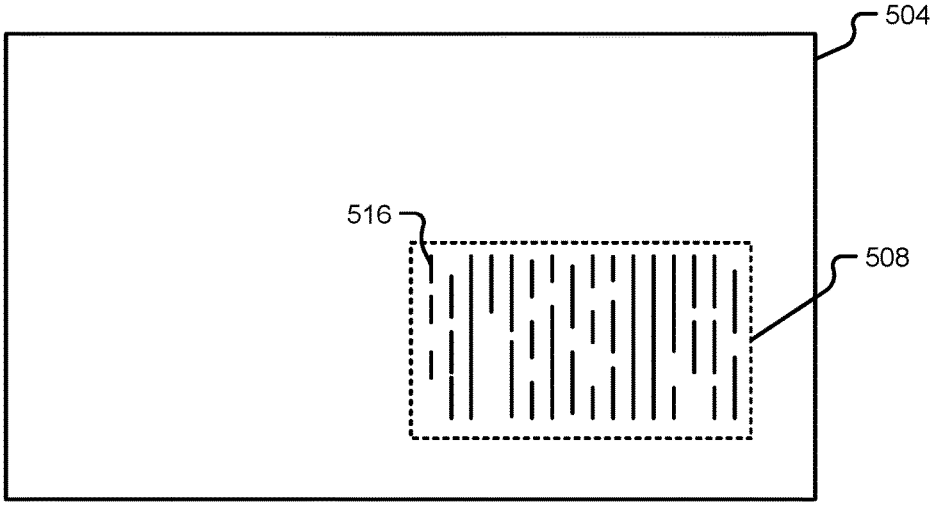
FIG. 5B is a diagram depicting the first example of the security feature after laser treatment in accordance with at least some embodiments of the present disclosure.

With reference now to FIGS. 5A-F, various examples of a secure document 504 and a security feature 508 provided thereon will be described in accordance with at least some embodiments of the present disclosure. With reference initially to FIGS. 5A-B, a first example of a security feature 508 will be described. The security feature 508 of FIGS. 5A-B is shown to include a plurality of columns of metal complex ink 512 that have been applied to a predetermined area of the secure document 504. Although the metal complex ink 512 is shown to be printed in a columnar format, it should be appreciated that the metal complex ink 512 may be printed in any regular or repeating pattern, which may or may not be linear. As some non-limiting examples, the lines of metal complex ink 512 may be printed in a row format, in a wavy line format, or in some other pattern that is repeating or predictable. In some embodiments, the printing of the metal complex ink 512 in an array format helps to facilitate an appropriate ablation of the metal complex ink 512. More specifically, FIG. 5B shows the security feature 508 after various predetermined portions of the metal complex ink 512 have been exposed to laser energy.

In some embodiments, a single line of the metal complex ink 512 may have multiple portions thereof removed, ablated, transformed, or otherwise treated with laser energy. Alternatively or additionally, a single line of the metal complex ink 512 may be left untouched by a laser whereas other adjacent lines of the metal complex ink 512 may have a portion thereof removed, ablated, transformed, or treated with laser energy. Alternatively or additionally, an entire line of the metal complex ink 512 may be removed, ablated, transformed, or treated with laser energy.

As can be appreciated, the application of laser energy to a metal complex ink 512 results in the creation of one or more laser-created features 516. Such features may be holographic in nature. Furthermore, an appropriate application of the laser energy within the security feature 508 may create or otherwise register an image within the structure of the metal complex ink 512. For instance, a holographic image may be registered in the metal complex ink 512 and the holographic image may exhibit a plasmonic effect. Although random portions of the metal complex ink 512 are shown to be treated with laser energy, it should be appreciated that the laser-created feature(s) 516 may follow a predetermined path within the security feature 508 or otherwise appear as a single, cohesive image. In this example, the removed portions of the metal complex ink 512 may present themselves as the predetermined image whereas the remaining portions of the metal complex ink 512 may correspond to non-image portions of the security feature 508. It should be appreciated, however, that the images may be presented as the remaining metal complex ink 512 material that has not been ablated, transformed, or otherwise removed from the secure document 504. Thus, the image may correspond to a positive color image (e.g., when the image corresponds to the remaining portions of the metal complex ink 512) or a negative color image (e.g., when the image corresponds to removed portions 516 of the metal complex ink 512), depending upon desired image effects, etc.

Figure 5C:
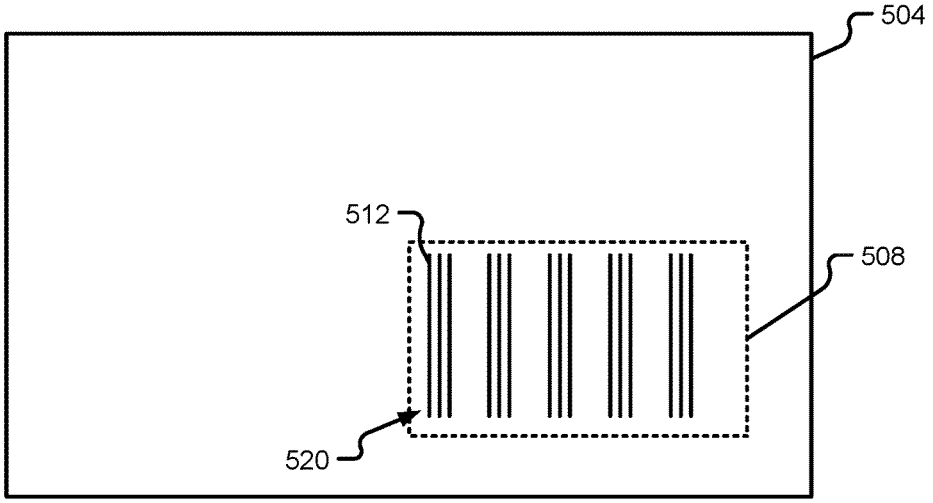
FIG. 5C is a diagram depicting a second example of a security feature prior to laser treatment in accordance with at least some embodiments of the present disclosure.
Figure 5D:
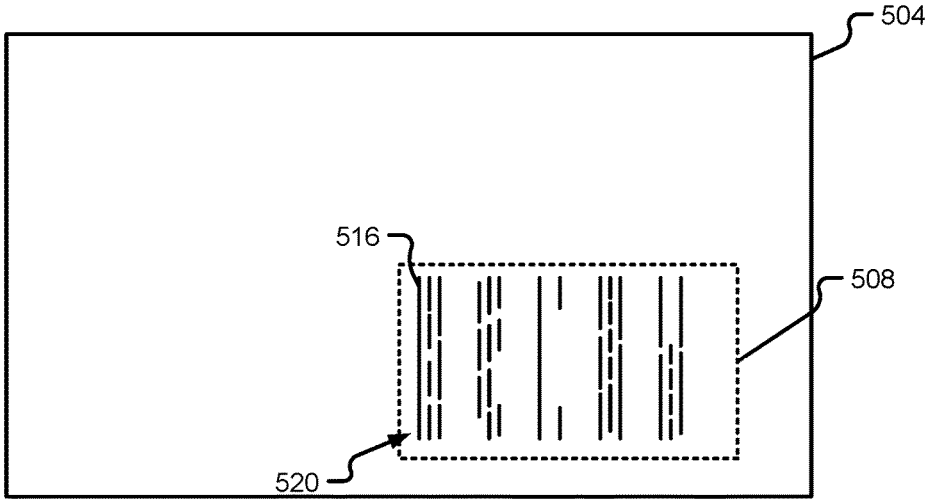
FIG. 5D is a diagram depicting the second example of the security feature after laser treatment in accordance with at least some embodiments of the present disclosure.

With reference now to FIGS. 5C-D, another example of the security feature 508 will be described in accordance with at least some embodiments of the present disclosure. Again, as with the first example of FIGS. 5A-B, the security feature 508 may include a plurality of lines of metal complex ink that are printed in a repeated pattern (e.g., in an array format, which may be linear or non-linear). In this example, however, two or more metal complex ink lines 512 are grouped or bunched together into an apparent set of metal complex ink features 520. In some embodiments, each line 512 of a particular set of metal complex ink features 520 may be created with a common type of metal complex ink. In other embodiments, each line 512 of a particular set of metal complex ink features 520 may be created with different types of metal complex ink. Thus, a plurality of different colors or image effects may be possible by ablating portions of some of the lines 512 in a set of features 520 without ablating other portions of some lines 512 in the same set of features. For instance, a predetermined image having a predetermined color or combination of colors may be created by ablating certain lines 512 that do not possess the predetermined color (at least in predetermined areas). Other lines 512 having the predetermined color (or other optical characteristic) may be left in the set 520 while the other lines are partially or completely removed with laser energy. As such, removed portions 516 can exist in each set 520 of lines to help create a predetermined image with the set 520 or lines 512.

Figure 5E:
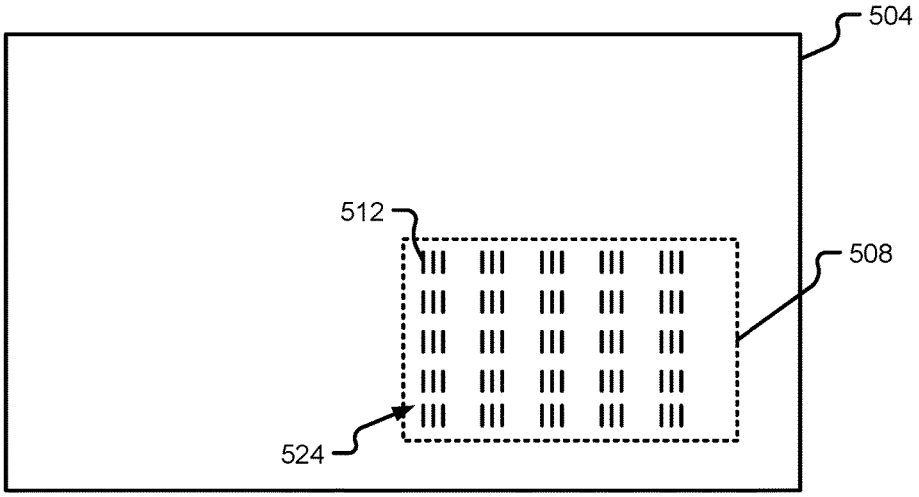
FIG. 5E is a diagram depicting a third example of a security feature prior to laser treatment in accordance with at least some embodiments of the present disclosure.
Figure 5F:
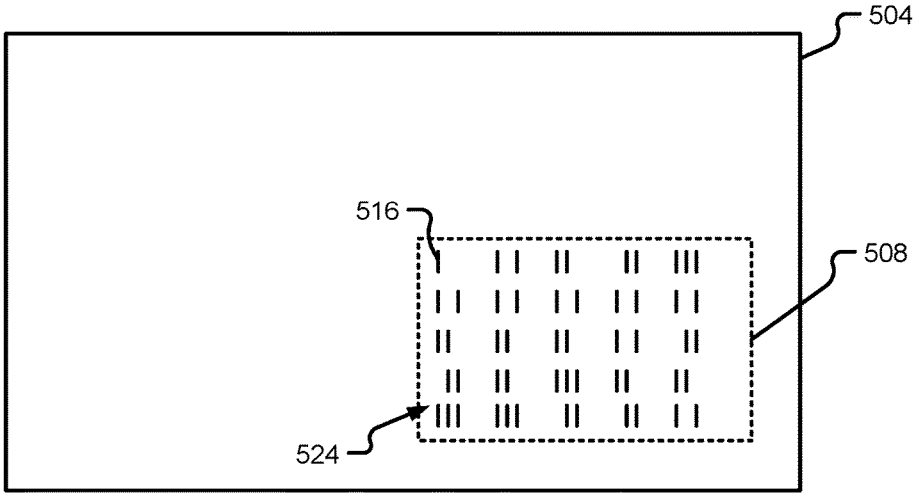
FIG. 5F is a diagram depicting the third example of the security feature after laser treatment in accordance with at least some embodiments of the present disclosure.

With reference now to FIGS. 5E-F, another example of a security feature 508 will be described in accordance with at least some embodiments of the present disclosure. This particular example shows the lines 512 being grouped into sets of rows and columns, but each set of lines is formed into a pixel set 524. Each pixel set 524 may include a plurality of different lines 512, which may be the same or different colors of metal complex ink. Images may be registered within the security feature 508 by ablating certain lines 512 from a particular pixel set 524 and leaving other lines in the pixel set 524. Although the lines 512 are shown to be relatively large in the figures, it should be appreciated that the lines 512 in each pixel set 524 may be very short (e.g., have a length on the order of tens of millimeters or tens of microns). Each pixel set 524 may be arranged in an array (columns and rows) such that predetermined images are created across the area of the security feature 508.

Figure 6:
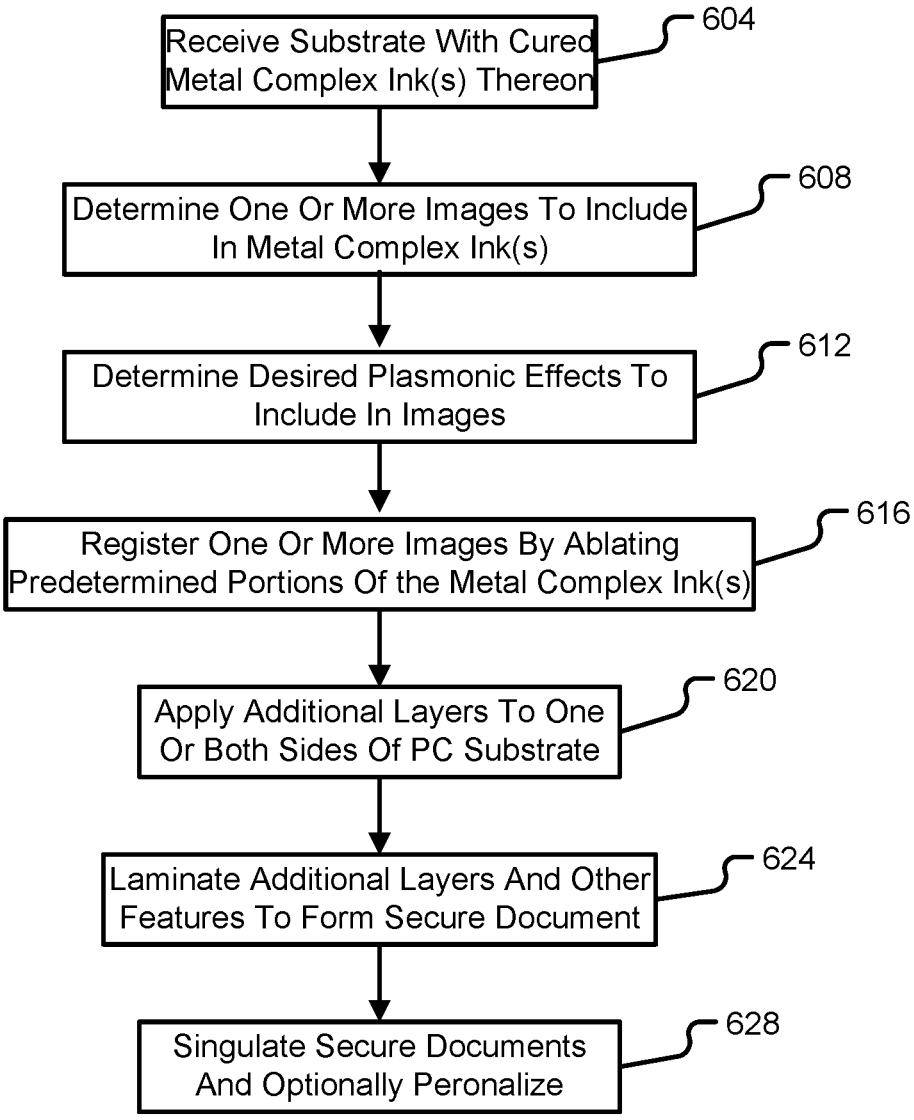
FIG. 6 is a flow diagram depicting another method of producing a secure document in accordance with at least some embodiments of the present disclosure.

With reference now to FIG. 6, another method of manufacturing a secure document will be described in accordance with at least some embodiments of the present disclosure. The method begins when a substrate is receiving with a plurality of metal complex ink cured thereon (step 604). The metal complex ink(s) may be laid out on the substrate in any fashion. In some embodiments, the metal complex ink(s) are printed on the substrate in adjacent rows, columns, or some other organized array of lines. The lines may or may not correspond to linear/straight lines.

The method continues by determining one or more images to include in the security feature provided by the metal complex ink(s) (step 608). The method may also include determining whether any particular plasmonic effects are to be included in the image (step 612). Based on the determinations of steps 608 and 612, the method continues by registering one or more images into the security feature by ablating predetermined portions of the metal complex inks (step 616). The image(s) may be registered using any of the processes depicted and described in connection with FIGS. 5A-F.

The method may then continue by applying additional layers to one or both sides of the substrate (step 620). The additional layers may be laminated with the substrate to form a secure document (step 624). Thereafter, individual secure documents may be separated from the laminated sheet (step 628). The individual secure documents may then be optionally personalized.

While the flowcharts have been discussed and illustrated in relation to a particular sequence of events, it should be appreciated that changes, additions, and omissions to this sequence can occur without materially affecting the operation of the disclosed embodiments, configuration, and aspects.

What is claimed is:

1. A method of manufacturing a secure document, comprising:

receiving a substrate having an embossed lacquer applied to a first side of the substrate;

applying a plurality of metal complex ink lines to the first side of the substrate;

curing the metal complex ink lines within a predetermined amount of time of applying the metal complex ink lines to the first side of the substrate; and applying laser energy to predetermined portions of the metal complex ink lines to produce an image within the metal complex ink lines, wherein the laser energy is applied to the predetermined portions of the metal complex ink lines after the metal complex ink lines have been cured.

2. The method of claim 1, further comprising:

creating a plasmonic effect in the image by ablating at least some portions of the metal complex ink lines.

3. The method of claim 1, wherein the metal complex ink lines are formed into sets of lines and wherein each set of lines comprises at least two different types of metal complex ink.

4. The method of claim 3, wherein a set of lines comprises a first metal complex ink and a second metal complex ink, wherein the first metal complex ink and second metal complex ink exhibit at least one different optical characteristic from one another, and wherein the image is produced by ablating certain portions of the first metal complex ink and not ablating a portion of the second metal complex ink that is adjacent to the certain portions of the first metal complex ink thereby causing the image to have an optical characteristic of the second metal complex ink near the certain portions of the first metal complex ink that have been ablated.

5. The method of claim 1, wherein the image produced in the metal complex ink lines corresponds to a holographic image.

6. The method of claim 1, wherein the laser energy applied to the predetermined portions of the metal complex ink lines causes the predetermined portions of the metal complex ink lines to transform into a metal oxide, thereby changing an appearance of the predetermined portions of the metal complex ink lines that are exposed to the laser energy as compared to other portions of the metal complex ink lines that are not exposed to the laser energy.

7. The method of claim 1, wherein the plurality of metal complex ink lines are formed in an array format.

8. The method of claim 1, wherein the plurality of metal complex ink lines are formed in a pixel array format.

9. The method of claim 8, wherein the pixel array comprises a plurality of pixel sets of metal complex ink lines that are adjacent to one another and wherein the image is produced by ablating some but not all of the metal complex ink lines in a pixel set.

10. The method of claim 9, wherein the pixel set comprises at least three different metal complex inks adjacent to one another and wherein each of the at least three different metal complex inks are applied to the substrate using inkjet print heads.

11. The method of claim 1, wherein the metal complex ink lines are cured by exposure to at least one of ultraviolet (UV) light and infrared (IR) light.

12. The method of claim 1, further comprising:

providing at least one electronic component over the substrate;

covering the at least one electronic component with a layer of polycarbonate; and laminating the layer of the polycarbonate to the substrate thereby fixing a position of the at least one electronic component between the substrate and the layer of polycarbonate.

13. A secure document, comprising:

a substrate having an embossed lacquer applied to a first side of the substrate;

a plurality of metal complex ink lines applied to the first side of the substrate; and a laser feature established in the plurality of metal complex ink lines, wherein the laser feature is an image that corresponds to at least a portion of the metal complex ink lines that have been oxidized.

14. The secure document of claim 13, wherein the metal complex ink lines are cured so as to exhibit a reflective finish.

15. The secure document of claim 14, wherein the metal complex ink lines comprise a silver nanoparticle ink.

16. The secure document of claim 15, wherein the metal complex ink lines are arranged into sets of lines such that lines in a first set of lines are nearer to one another than to any line in a second set of lines.

17. The secure document of claim 13, wherein the plurality of metal complex ink lines are arranged in an array format and are formed into pixel sets of lines.

18. The secure document of claim 17, wherein each pixel set of lines comprises at least two different types of metal complex ink that exhibit different optical characteristics from one another.

19. A secure document, comprising:

a polycarbonate substrate;

an embossed lacquer provided on at least one surface of the polycarbonate substrate; and a security feature provided on the polycarbonate substrate, wherein the security feature at least partially conforms to the embossed lacquer and comprises a plurality of metal complex ink lines that have portions thereof which have been exposed to laser energy and wherein said exposed portions are transformed to metal oxide, thereby creating an image in the plurality of metal complex ink lines.

20. The secure document of claim 19, wherein the metal complex ink lines comprise a first metal complex ink and a second metal complex ink applied in an array format with spacing therebetween.

* * * * *